US008247960B2

(12) United States Patent
Wang et al.

(10) Patent No.: US 8,247,960 B2
(45) Date of Patent: Aug. 21, 2012

(54) 3-DIMENSION FACET LIGHT-EMITTING SOURCE DEVICE AND STEREOSCOPIC LIGHT-EMITTING SOURCE DEVICE

(75) Inventors: Po-Hung Wang, Kaohsiung County (TW); Yi-Ping Lin, Changhua County (TW); Yen-I Chou, Hsinchu (TW); Ming-Chung Liu, Taoyuan County (TW); Jung-Yu Li, Taipei County (TW); Shih-Pu Chen, Hsinchu (TW); Jung-Ya Hsieh, Taichung (TW); Ta-Wei Chien, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 146 days.

(21) Appl. No.: 12/770,732

(22) Filed: Apr. 30, 2010

(65) Prior Publication Data

US 2011/0227498 A1 Sep. 22, 2011

(30) Foreign Application Priority Data

Mar. 16, 2010 (TW) ..... 99107617 A

(51) Int. Cl.
*H01J 61/30* (2006.01)
*H01J 63/04* (2006.01)

(52) U.S. Cl. ..... 313/493; 313/495; 313/496; 313/610; 313/484; 313/485; 313/491

(58) Field of Classification Search ..... 313/491, 313/493, 495
See application file for complete search history.

(56) References Cited

U.S. PATENT DOCUMENTS

| | | | | |
|---|---|---|---|---|
| 4,851,734 | A * | 7/1989 | Hamai et al. | 313/485 |
| 4,920,298 | A * | 4/1990 | Hinotani et al. | 313/493 |
| 4,931,651 | A * | 6/1990 | Kagami et al. | 313/495 |
| 7,134,761 | B2 * | 11/2006 | Francke | 362/84 |
| 7,876,035 | B2 * | 1/2011 | Yang et al. | 313/495 |
| 2002/0079826 | A1 * | 6/2002 | Park | 313/483 |
| 2003/0001492 | A1 * | 1/2003 | Pei et al. | 313/496 |
| 2008/0143241 | A1 * | 6/2008 | Li et al. | 313/496 |
| 2008/0157652 | A1 * | 7/2008 | Li et al. | 313/496 |
| 2010/0123383 | A1 | 5/2010 | Li et al. | |

FOREIGN PATENT DOCUMENTS

| | | |
|---|---|---|
| CN | 101211748 | 7/2008 |
| CN | 101303962 | 11/2008 |

(Continued)

OTHER PUBLICATIONS

English abstract of JP 02029697 A to Iwasaki.*
"Office Action of Japan Counterpart Application", issued on Jun. 19, 2012, p1-p2, in which the listed reference was cited.

(Continued)

*Primary Examiner* — Sikha Roy
(74) *Attorney, Agent, or Firm* — Jianq Chyun IP Office

(57) ABSTRACT

A 3-dimension facet light-emitting source device including a transparent container, an anode plate, a cathode plate, a plurality of transparent plates and a low-pressure gas layer is provided. The transparent container has a sealed space. The transparent plates are disposed between the anode plate and the cathode plate, and have a fluorescent layer thereon respectively. The lower pressure gas layer is filled in the sealed space to induce electrons emitting from the cathode plate, and the electrons fly in a direction parallel to the transparent plates and hit each fluorescent layer to emit light, so as to form a set of 3-dimension facet patterns.

13 Claims, 4 Drawing Sheets

FOREIGN PATENT DOCUMENTS

| | | | | |
|---|---|---|---|---|
| CN | 101471224 | | | 7/2009 |
| JP | 02029697 | A | * | 1/1990 |
| JP | 11339724 | | | 12/1999 |
| WO | 03054902 | | | 7/2003 |

OTHER PUBLICATIONS

"First Office Action of China Counterpart Application", issued on Jun. 20, 2012, p1-p7, in which the listed references were cited.

* cited by examiner

3-DIMENSION FACET LIGHT-EMITTING SOURCE DEVICE AND STEREOSCOPIC LIGHT-EMITTING SOURCE DEVICE

CROSS-REFERENCE TO RELATED APPLICATION

This application claims the priority benefit of Taiwan application serial no. 99107617, filed on Mar. 16, 2010. The entirety of the above-mentioned patent application is hereby incorporated by reference herein and made a part of specification.

BACKGROUND OF THE INVENTION

1. Field of the Disclosure

The present disclosure relates to a light-emitting source device. More particularly, the present disclosure relates to a 3-dimension facet light-emitting source device and a stereoscopic light-emitting source device.

2. Description of Related Art

Light source devices are widely used in daily life. After a long time research and development of a conventional point light source, a planar light-emitting device with a low power consumption, an even light-emitting effect is developed, which can be widely applied to planar displays, billboards of building appearance or architectural lighting, etc. Regarding the conventional point light sources or the planar light sources, for example, tungsten lamps, cold cathode-ray tubes (CRT) or light-emitting diode (LED) array light sources, etc., the used lamps generally have standard shapes such as round and rod-like shapes, so that in a commercial utilization, such as installation art or decoration illumination, an extra mask or other structures have to be used to shield the light-emitting source that is not a main part of the installation art. Therefore, usage of the light-emitting sources is limited.

Moreover, regarding the installation art of a building's outer wall or a glass showcase, a modern architecture may apply a large number of transparent glasses as green building materials to achieve advantages of long service life and convenience in maintenance, etc. An advantage of the glass building material is that the sunlight during the daytime can be used to assist the artificial lighting, so that the power used for illumination is saved, and a comfortable and natural illumination space is also provided. In recent years, display devices using an organic electroluminescence mechanism have been applied to the glass building materials, though a usage rate thereof is low due to disadvantages of high cost and inconvenience in maintenance.

The present disclosure provides a different thought and usage custom in allusion to the illumination design of the conventional light-emitting source, which can be flexibly applied to 3-dimension, planar display devices or dynamic light-emitting art installations. Therefore, the light-emitting source is not only used for illumination, but can also be used in collaboration with different light-emitting patterns and colors according to different illumination design, so that the light-emitting source itself can serve as a main part of the installation art, and additional processing of the light-emitting source or usage of an extra mask is unnecessary, so as to improve an application level of the light-emitting source.

SUMMARY

The present disclosure is directed to a 3-dimension facet light-emitting source device, which can improve an application level of a light-emitting source.

The present disclosure is directed to a stereoscopic light-emitting source device, which can improve an application level of a light-emitting source.

The present disclosure provides a 3-dimension facet light-emitting source device including a transparent container, an anode plate, a cathode plate, a plurality of transparent plates and a low-pressure gas layer. The transparent container has a first side, a second side and a sealed space. The anode plate is disposed at the first side. The cathode plate is disposed at the second side, and is located in the transparent container opposite to the anode plate. The transparent plates are disposed between the anode plate and the cathode plate, and each of the transparent plates has a fluorescent layer. The low-pressure gas layer is filled in the sealed space to induce electrons emitting from the cathode plate, and the electrons fly in a direction parallel to the transparent plates and hit each fluorescent layer to emit light, so as to form a set of 3-dimension facet patterns.

The present disclosure provides a stereoscopic light-emitting source device including a transparent container, an anode plate, a cathode plate, a fluorescent layer and a low-pressure gas layer. The transparent container has a first side, a second side and a sealed space. The anode plate is disposed at the first side. The cathode plate is disposed at the second side, and is located in the transparent container opposite to the anode plate. The fluorescent layer is formed on a stereoscopic object in the transparent container, and the stereoscopic object includes a transparent object or a translucent object. The low-pressure gas layer is filled in the sealed space to induce electrons emitting from the cathode plate, and the electrons fly and hit the fluorescent layer to emit light, so as to form a stereoscopic pattern.

In order to make the aforementioned and other features and advantages of the present disclosure comprehensible, several exemplary embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DETAILED DESCRIPTION OF DISCLOSED EMBODIMENTS

Figure 1:
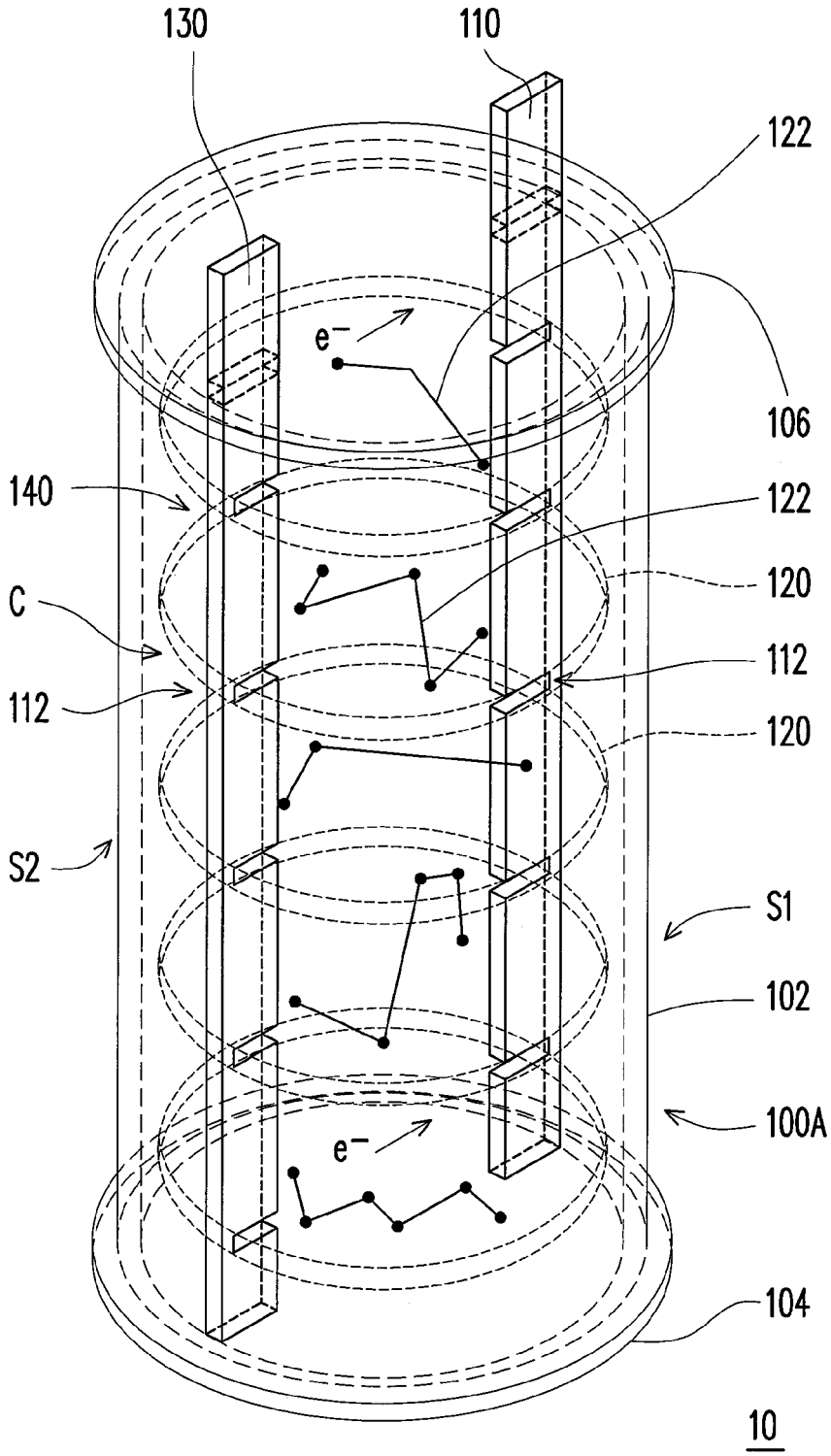
FIGS. 1-5 are schematic diagrams respectively illustrating light-emitting source devices according to five exemplary embodiments of the present disclosure.

The present disclosure provides a 3-dimension facet light-emitting source device, in which a gas discharge under a low-pressure environment can induce an enough number of electrons emitting from a cathode plate, and the electrons can be accelerated by an electric field in the thin low-pressure gas and fly to hit a fluorescent layer. Since a mean free path of the electrons in the low-pressure gas is relatively long, enough number of the electrons can hit the fluorescent layer, so that the kinetic energy of the electron is converted into the light energy to achieve a light-emitting effect.

Moreover, such light-emitting mechanism has characteristics and advantages that cannot be achieved by a general light source. For example, the above light-emitting mechanism has a transparent and luminescence characteristic, and a wavelength of the emitted light is determined according to a composition of the phosphor powder, and the light sources with different wavelength ranges can be designed according to different requirements of illumination environments. Moreover, the above light source mechanism has a feature of a short light-emitting response time, and linear dimming, etc., so as to satisfy light-emitting patterns of different environments. In terms of ergonomics and visual comfort, a planar light source has an advantage of lower light intensity of a unit area, and the planar light source does not generate a glare that makes eyes discomfort, so that compared to a point light source, a dazzling visual residue is avoided, which is more in line with basic needs of human health and decoration illumination. In terms of the fabrication process, there is none semiconductor or organic chemistry pollutant, and the device itself does not contain mercury, which is belonged to a green environmental-protection light source, and is coped with a future environmental protection need. Based on these advantages, a flexibility of market applications and product added value of the 3-dimension facet light-emitting source device is rather high. Therefore, besides providing the illumination, the light-emitting mechanism of the present disclosure can be flexibly applied to 3-dimension, planar display devices or dynamic light-emitting art installations. A material of a transparent substrate of the present disclosure can be a rigid material or a flexible material. Moreover, the light-emitting source device can be a single-side, a double-side or a facet light-emitting source device, which can be varied along with an actual requirement. Exemplary embodiments are provided below for further descriptions, though the present disclosure is not limited to the provided exemplary embodiments, and the provided exemplary embodiments can be mutually combined, which are unnecessarily to be individually independent embodiment.

In the following exemplary embodiment, a gas in a low-pressure gas layer can be an inert gas, air, hydrogen ($H_2$), carbon dioxide ($CO_2$) or oxygen ($O_2$). In a following table, corresponding values of driving voltages and currents are listed in case that the working gas is nitrogen.

| | Pressure (Torr) | Voltage (Volt) | Current (μA) |
|---|---|---|---|
| 1 | 6.2E−3 | 7000 | 155 |
| 2 | 1.0E−2 | 4000 | 210 |
| 3 | 5.0E−2 | 3000 | 2965 |
| 4 | 8.0E−2 | 2500 | 3350 |
| 5 | 1.0E−1 | 2400 | 3820 |
| 6 | 1.5E−1 | 2200 | 3960 |
| 7 | 3.0E−1 | 1900 | 3880 |
| 8 | 8.0E−1 | 1900 | 3890 |
| 9 | 1.0E0 | 1900 | 3780 |
| 10 | 1.9E0 | 2100 | 3910 |
| 11 | 2.5E0 | 2250 | 3950 |
| 12 | 3.0E0 | 2400 | 3800 |

Figure 2:
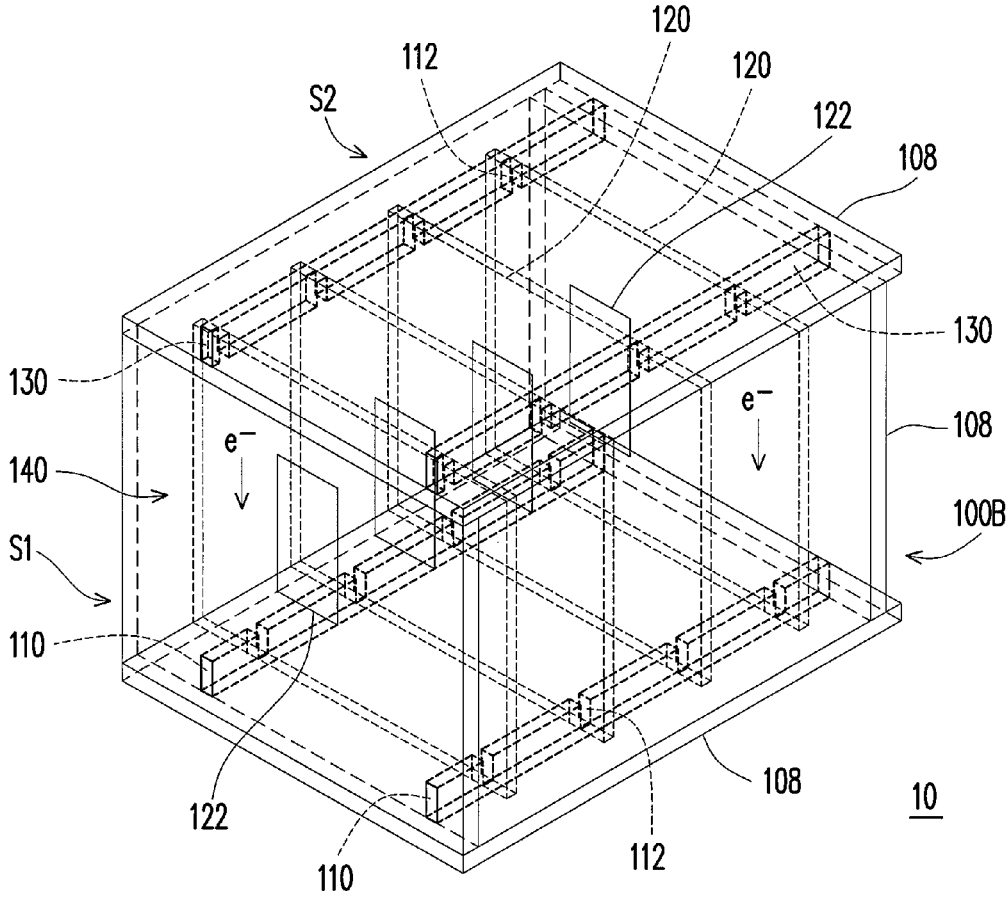

FIGS. 1-5 are schematic diagrams respectively illustrating light-emitting source devices according to five exemplary embodiments of the present disclosure. Referring to FIG. 1 and FIG. 2, a 3-dimension facet light-emitting source device 10 includes at least a transparent container 100A or 100B, an anode plate 110 (which can be a piece of glass plated with conductive film or a processed metal plate), a plurality of transparent plates 120, a cathode plate 130 (which can be a piece of glass plated with conductive film or a processed metal plate), and a low-pressure gas layer 140. A material of the transparent container 100A or 100B is, for example, transparent glass, which has a first side S1, a second side S2 and a sealed space C. The anode plate 110 and the cathode plate 130 are disposed in the transparent container 100A or 100B opposite to each other. The low-pressure gas layer 140 is filled in the sealed space C to induce an enough number of electrons $e^-$ emitting from the cathode plate 130, and the electrons $e^-$ fly in a direction parallel to the transparent plates 120 and hit fluorescent layers 122 on the transparent plates 120 to emit light.

In the exemplary embodiment shown in FIG. 1, the transparent container 100A includes a transparent hollow pillar 102, a first end plate 104 and a second end plate 106, which can serve as a glass showcase used for demonstration. The first end plate 104 and the second end plate 106 are located at two ends of the transparent hollow pillar 102 to form the sealed space C. Moreover, the anode plate 110 and the cathode plate 130 are respectively disposed at the first side S1 and the second side S2 of the transparent container 100A, and are strip-shaped plates having a plurality of grooves 112 (dentations), so that the transparent plates 120 can be arranged in interval along a length direction of the two strip-shaped plates, and can be fixed in the grooves 112. In the present exemplary embodiment, each of the transparent plates 120 has the fluorescent layer 122, which can emit visible lights with required wavelengths according to different fluorescent materials. Each of the fluorescent layers 122 emits light when being indirectly hit by the electrons $e^-$, so as to form a set of 3-dimension facet patterns. A pattern of the fluorescent layer 122 is designed according to an actual requirement (for example, designed as a Milky Way galaxy map), which can be directly printed on the transparent plates 120 through screen printing or spraying. A number of the transparent plates 120 is not limited to five, which can be increased or decreased according to an actual requirement.

In the exemplary embodiment of FIG. 2, the transparent container 100B is a hollow box formed by a top, a bottom, a left, a right, a front and a back transparent substrates 108, which can serve as a glass showcase used for demonstration. Similar to the configuration of FIG. 1, the anode plate 110 and the cathode plate 130 of FIG. 2 are disposed at the first side S1 and the second side S2 of the transparent container 100B, and are strip-shaped plates having a plurality of grooves 112 (dentations), so that the transparent plates 120 can be arranged in interval along a length direction of the two strip-shaped plates, and can be fixed in the grooves 112. In the present exemplary embodiment, each of the transparent plates 120 has the fluorescent layer 122, which can emit light when being hit by the electrons $e^-$, so as to form a set of 3-dimension facet patterns.

Figure 3:
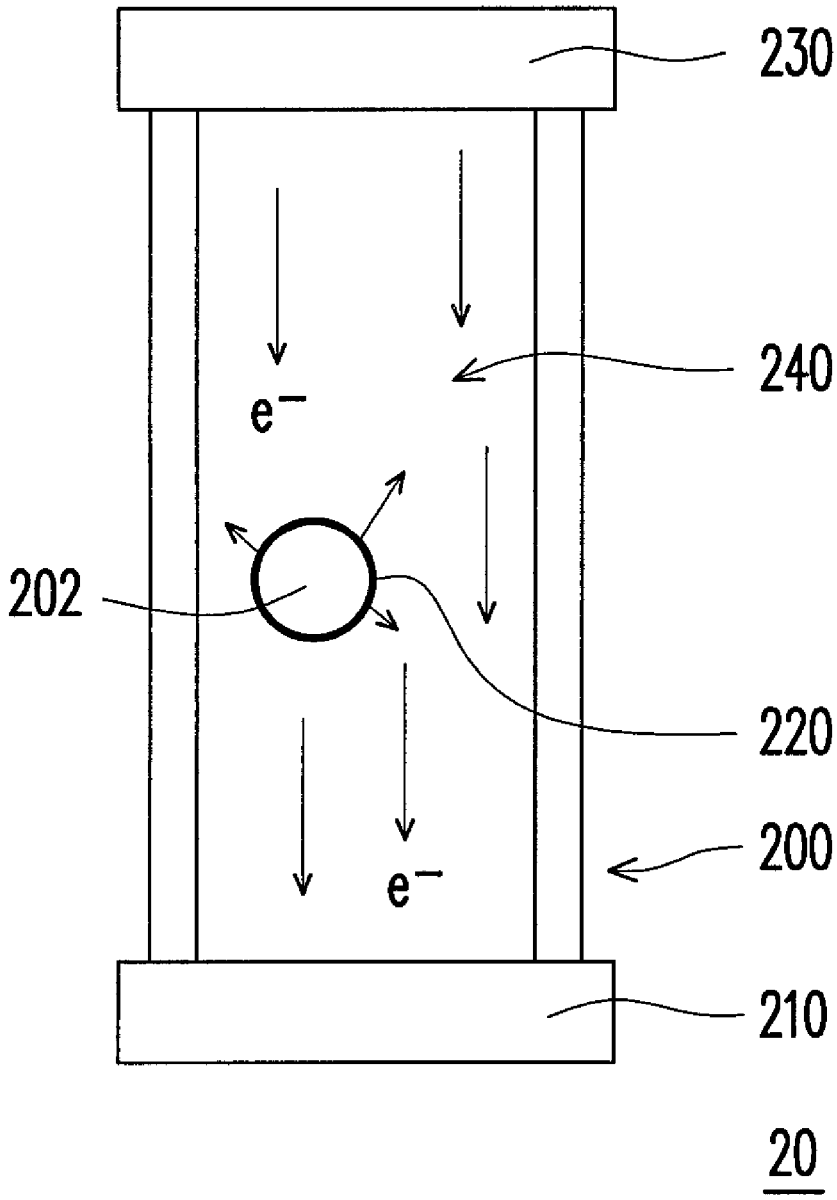

Referring to FIG. 3, in an exemplary embodiment of FIG. 3, a stereoscopic light-emitting source device 20 includes at least a transparent container 200, an anode plate 210, a fluorescent layer 220, a cathode plate 230 and a low-pressure gas layer 240. The transparent container 200 further has a stereoscopic object 202, which is, for example, a main part of the installation art, and the fluorescent layer 220 is formed on the stereoscopic object 202 and can emit visible lights with required wavelengths according to different fluorescent materials. The electrons $e^-$ hit the fluorescent layer 220 to emit light, so as to form a stereoscopic pattern. The stereoscopic pattern is formed by the fluorescent layer 220 with at least two colors or patterns, and the fluorescent layer 220 can be formed on different surfaces of the stereoscopic object 202. The patterns of the fluorescent layer 220 are determined according to a shape of the stereoscopic object 202, which can be a sphere, a line or any stereoscopic shapes. The shape and material of the stereoscopic object 202 are not limited by the present exemplary embodiment, and the stereoscopic object 202 can be a transparent object or a translucent object, for example, a glass tube, a metal tube or any other wire rod with a suitable shape.

Figure 4:
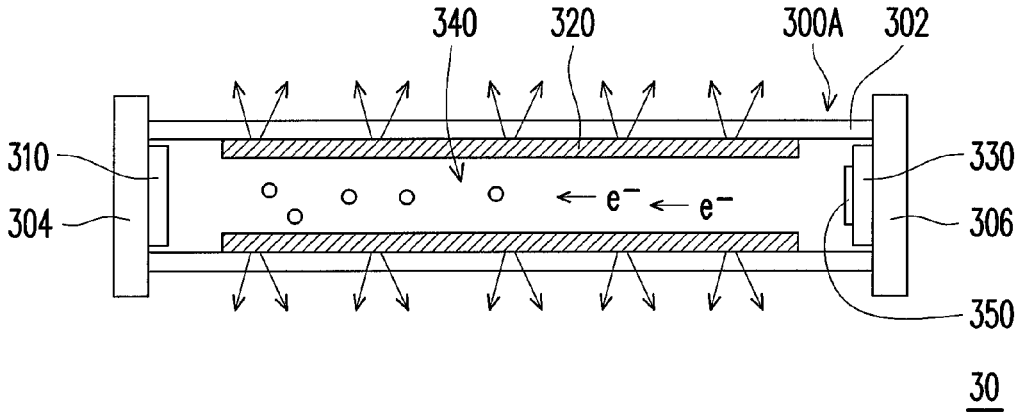

In an exemplary embodiment of FIG. 4, a stereoscopic light-emitting source device 30 includes at least a transparent container 300A, an anode plate 310, a fluorescent layer 320, a cathode plate 330 and a low-pressure gas layer 340. The transparent container 300A includes a transparent hollow pillar 302, a first end plate 304 and a second end plate 306, which can serve as a rod-shaped lamp of a light-emitting source, and has a shape of, for example, a fluorescent lamp, though a light-emitting mechanism thereof is different to that of the fluorescent lamp, and the fluorescent materials are also different. The first end plate 304 and the second end plate 306 are located at two ends of the transparent hollow pillar 302 to form a sealed space C. Moreover, the anode plate 310 and the cathode plate 330 are respectively disposed on the first end plate 304 and the second end plate 306 of the transparent container 300A. The fluorescent layer 320 is formed on an inner wall of the transparent hollow pillar 302, which can emit visible lights with required wavelengths according to different fluorescent materials. When the electrons $e^-$ hit the fluorescent layer 320 to emit light, a stereoscopic pattern is formed.

Figure 5:
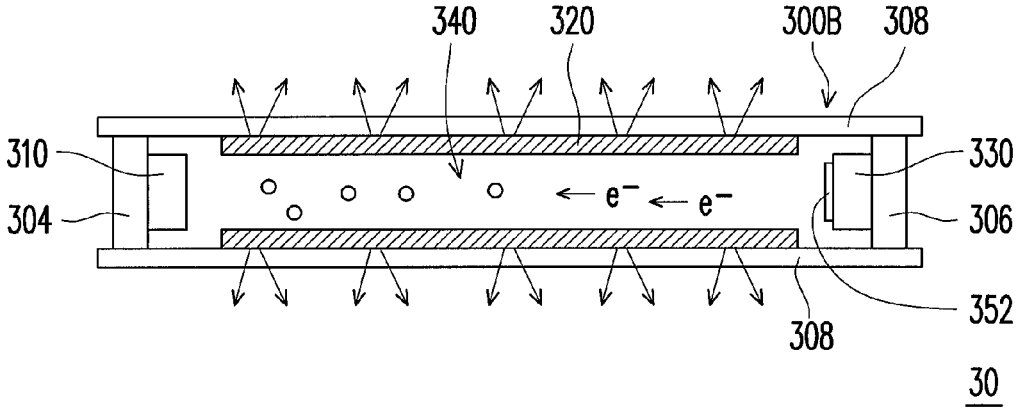

In an exemplary embodiment of FIG. 5, a transparent container 300B includes a first end plate 304, a second end plate 306 and two transparent substrates 308, which can serve as a lamp of a double-side light-emitting source. The first end plate 304 and the second end plate 306 can form a frame, and can be connected to the two transparent substrates 308 to form a sealed space C. Moreover, the anode plate 310 and the cathode plate 330 are respectively disposed on the first end plate 304 and the second end plate 306 of the transparent container 300B. The fluorescent layer 320 is formed on an inner wall of the two transparent substrates 308, which can emit visible lights with required wavelengths according to different fluorescent materials. When the electrons $e^-$ hit the fluorescent layer 320 to emit light, a stereoscopic pattern is formed. The fluorescent layer 320 is not limited to a pattern formed by a single fluorescent material, which can also be a gray-level picture, text or a color picture, etc.

In the above exemplary embodiments, the anode plates 110, 210 and 310 and the cathode plates 130, 230 and 330 have transparent conductive materials thereon, and are driven by a direct current (DC) power source, an alternating current (AC) power source, or a DC pulse power source, so as to generate an electric field between the anode plate and the cathode plate. The transparent conductive material is, for example, a transparent material such as indium tin oxide (ITO), indium zinc oxides (IZO), fluorine-doped tin oxide (FTO), aluminium doped zinc oxide (AZO), or other transparent conductive oxide, etc.

A gas pressure of the low-pressure gas layer 140, 240 or 340 is, for example, within a range of $10\text{-}10^{-3}$ torr. The gas of the low-pressure gas layer can be an inert gas, air, hydrogen ($H_2$), carbon dioxide ($CO_2$) or oxygen ($O_2$), wherein the inert gas includes nitrogen (N2), helium (He), neon (Ne), argon (Ar), krypton (Kr) and xenon (Xe), etc.

The low-pressure gas layer 140, 240 or 340 is filled in the sealed space C, which can be used to induce electrons evenly emitting from the cathode plate. Further, the low-pressure gas layer has a mean free path for the electrons, which can accelerate an enough number of electrons $e^-$ to move towards the anode plate under an operating voltage, and the electrons can indirectly hit the fluorescent layer to emit light. Moreover, in the low-pressure gas layer, some free positive ions can hit the cathode plate to generate some secondary electrons, so as to increase the number of the electrons.

To facilitate inducing the electrons from the cathode plate 130, 230 or 330, a secondary electron source material layer 350 (as that shown in FIG. 4) can be selectively formed on a surface of the cathode plate, and a material thereof is, for example, magnesium oxide (MgO), silicon dioxide ($SiO_2$), terbium oxide ($Th_2O_3$), lanthanum oxide ($La_2O_3$), aluminium oxide ($Al_2O_3$) or cerium oxide ($CeO_2$). The secondary electron source material layer 350 covers the cathode plate to increase the number of the secondary electrons, which also has a function of protection. Moreover, to facilitate inducing the electrons from the cathode plate 130, 230 or 330, an electron radiation layer 352 (as that shown in FIG. 5) can be selectively formed on the surface of the cathode plate, and the electron radiation layer 352 can be formed by a material such as carbon nanotube, carbon nanowall, carbon nanoporous, columnar zinc oxide (ZnO), zinc oxide or diamond film, etc., so as to assist the cathode plate to release the electrons and reduce the operating voltage. Moreover, though it is not illustrated, in the present exemplary embodiment, the secondary electron source material layer 350 and the electron radiation layer 353 can also be formed on the anode plate 110, 210 or 310, which has a same purpose of inducing the electrons from the cathode plate, and therefore detailed descriptions thereof are not repeated.

In summary, a high vacuum package of the low-pressure gas layer in the light-emitting source device of the present disclosure is unnecessary, so that a manufacturing process thereof can be simplified, which avails a mass production. Moreover, the light-emitting source device of the present disclosure has a great improvement in presentation, illumination and energy-saving, and can be flexibly applied to 3-dimension, planar displays or dynamic light-emitting art installations. Therefore, the light-emitting source is not only used for illumination, but can also be used in collaboration with different light-emitting patterns and colors according to different illumination design, so that the light-emitting source itself can serve as a main part of the installation art, and additional processing of the light-emitting source or usage of an extra mask is unnecessary, so as to improve an application level of the light-emitting source.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A 3-dimension facet light-emitting source device, comprising:

a transparent container, having a first side, a second side and a sealed space and remaining transparent at multiple sides;

an anode plate, disposed at the first side;

a cathode plate, disposed at the second side, and located in the transparent container opposite to the anode plate;

a plurality of transparent plates, disposed between the anode plate and the cathode plate, wherein each of the transparent plates has two opposite plane surfaces and each transparent plate has a fluorescent layer on at least one of the two plane surfaces; and a low-pressure gas layer, filled in the sealed space to induce electrons emitting from the cathode plate, wherein the electrons fly in a direction parallel to the transparent plates and hit each fluorescent layer to emit light, and light emitting from the fluorescent layers penetrates through and emits from the multiple sides of the transparent container to form a set of 3-dimension facet patterns.

2. The 3-dimension facet light-emitting source device as claimed in claim 1, wherein the transparent container comprises a hollow pillar or a hollow box.

3. The 3-dimension facet light-emitting source device as claimed in claim 1, wherein the anode plate and the cathode plate are strip-shaped plates having a plurality of grooves, and the transparent plates are arranged in interval along a length direction of the two strip-shaped plates, and are fixed in the grooves.

4. The 3-dimension facet light-emitting source device as claimed in claim 1, wherein the anode plate and the cathode plate are driven by a direct current (DC) power source, an alternating current (AC) power source or a DC pulse power source.

5. The 3-dimension facet light-emitting source device as claimed in claim 1, wherein the anode plate and the cathode plate are transparent conductive materials.

6. The 3-dimension facet light-emitting source device as claimed in claim 1, wherein the anode plate and/or the cathode plate further has an electron radiation layer thereon.

7. The 3-dimension facet light-emitting source device as claimed in claim 6, wherein a material of the electron radiation layer comprises carbon nanotube, carbon nanowall, carbon nanoporous, zinc oxide or diamond film.

8. The 3-dimension facet light-emitting source device as claimed in claim 1, wherein the anode plate and/or the cathode plate further comprises a secondary electron source material layer thereon.

9. The 3-dimension facet light-emitting source device as claimed in claim 1, wherein a material of the secondary electron source material layer comprises MgO, $SiO_2$, $Tb_2O_3$, $La_2O_3$, $Al_2O_3$ or $CeO_2$.

10. The 3-dimension facet light-emitting source device as claimed in claim 1, wherein a gas pressure of the low-pressure gas layer is within a range of $10\text{-}10^{-3}$ torr.

11. A stereoscopic light-emitting source device, comprising:

a transparent container, having a first side, a second side and a sealed space and remaining transparent at multiple sides;

an anode plate, disposed at the first side;

a cathode plate, disposed at the second side, and is located in the transparent container opposite to the anode plate;

a fluorescent layer, formed on an exterior surface of a transparent or translucent stereoscopic object in the sealed space of the transparent container, wherein the transparent or translucent stereoscopic object and the fluorescent layer thereon are disposed between the anode plate and the cathode plate; and a low-pressure gas layer, filled in the sealed space to induce electrons emitting from the cathode plate, wherein the electrons fly from the cathode plate toward the anode plate and hit the fluorescent layer on the transparent or translucent stereoscopic object to emit light, and light emitting from the fluorescent layer on the transparent or translucent stereoscopic object penetrates through and emits from the multiple sides of the transparent container to form a stereoscopic pattern.

12. The stereoscopic light-emitting source device as claimed in claim 11, wherein a gas pressure of the low-pressure gas layer is within a range of $10\text{-}10^{-3}$ torr.

13. The stereoscopic light-emitting source device as claimed in claim 11, wherein the fluorescent layer with at least two colors or patterns is formed on different surfaces of the stereoscopic object, so as to form the stereoscopic pattern.

* * * * *